US006866817B2

(12) United States Patent
Hsiao

(10) Patent No.: US 6,866,817 B2
(45) Date of Patent: Mar. 15, 2005

(54) ALUMINUM BASED MATERIAL HAVING HIGH CONDUCTIVITY

(76) Inventor: Chung-Chih Hsiao, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/620,969

(22) Filed: Jul. 14, 2003

(65) Prior Publication Data

US 2005/0013725 A1 Jan. 20, 2005

(51) Int. Cl.[7] ..... C22C 21/00
(52) U.S. Cl. ..... 420/535; 148/417; 148/439
(58) Field of Search ..... 148/417, 439; 420/535, 528–554

(56) References Cited

U.S. PATENT DOCUMENTS 3,811,846 A * 5/1974 Schoernere t al. ..... 420/535
5,620,652 A * 4/1997 Tack et al. ..... 420/532
5,624,632 A * 4/1997 Baumann et al. ..... 420/544

* cited by examiner

*Primary Examiner*—George Wyszomierski
*Assistant Examiner*—Janelle Morillo

(57) ABSTRACT

An aluminum based material includes the elements of scandium (Sc), silicon (Si), magnesium (Mg), zirconium (Zr), copper (Cu), and aluminum (Al). Thus, the aluminum based material can be used to make a heatsink plate having a heatsink effect of 20%, so that the aluminum based material has a greater conductivity and heatsink effect. In addition, the aluminum crystal has a fined size smaller than 0.1 nanometer (0.1 nm), thereby facilitating the later working process, so that the aluminum based material can be worked easily and conveniently.

3 Claims, No Drawings

ALUMINUM BASED MATERIAL HAVING HIGH CONDUCTIVITY

BACKGROUND OF THE INVENTION

1. Field of the Invention

The present invention relates to an aluminum based material, and more particularly to an aluminum based material having an enhanced heat conductivity.

2. Description of the Related Art

The aluminum alloy may be used to make the heatsink plate of a heat exchanger, such as the radiator, cooler or evaporator of the automobile. The aluminum alloy (such as AA3003) of the heatsink plate of the conventional radiator contains a great deal of manganese (Mn) so as to enhance the strength of the heatsink plate, thereby facilitating the soldering process. However, the manganese has a very poor heat conductivity, thereby greatly decreasing the heatsink effect of the heatsink plate. In addition, if the content of the manganese contained in the aluminum alloy is reduced to increase the heatsink effect of the heatsink plate, the strength of the heatsink plate is greatly weakened, so that the aluminum alloy cannot be worked easily to proceed the later working process.

SUMMARY OF THE INVENTION

The primary objective of the present invention is to provide an aluminum based material that can be used to make a heatsink plate having a heatsink effect of 20%, so that the aluminum based material has a greater conductivity and heatsink effect.

Another objective of the present invention is to provide an aluminum based material, wherein the aluminum crystal has a fined size smaller than 0.1 nanometer (0.1 nm), thereby facilitating the later working process, so that the aluminum based material can be worked easily and conveniently.

A further objective of the present invention is to provide an aluminum based material that is made of elements of smaller heat resistance and greater strength, so that the aluminum based material has greater heat conductivity and strength.

In accordance with the present invention, there is provided an aluminum based material, comprising the elements of scandium (Sc), silicon (Si), magnesium (Mg), zirconium (Zr), copper (Cu), and aluminum (Al), wherein:

the scandium has a proportion ranged between 0.01% and 0.5%;

the silicon has a proportion ranged between 0.01% and 0.5%;

the magnesium has a proportion ranged between 0.01% and 0.5%;

the zirconium has a proportion ranged between 0.01% and 0.5%;

the copper has a proportion ranged between 0.01% and 0.5%; and the aluminum has a proportion ranged between 97.5% and 99.95%.

Further benefits and advantages of the present invention will become apparent after a careful reading of the detailed description with appropriate reference to the accompanying drawings.

BRIEF DESCRIPTION OF THE DRAWINGS

No figure is attached.

DETAILED DESCRIPTION OF THE INVENTION

The aluminum based material (the aluminum alloy) having high conductivity in accordance with the preferred embodiment of the present invention comprises scandium (Sc), silicon (Si), magnesium (Mg), zirconium (Zr), copper (Cu), and aluminum (Al).

The scandium has a proportion ranged between 0.01% and 0.5%. Preferably, the scandium can reduce production of the heat resistance during the plastic deformation of the alloy so as to enhance the heat conductive effect of the alloy, and to improve the hardness and heat durability of the alloy.

The silicon has a proportion ranged between 0.01% and 0.5%. Preferably, the silicon can enhance the strength of the alloy.

The magnesium has a proportion ranged between 0.01% and 0.5%. Preferably, the magnesium can enhance the strength of the alloy.

The zirconium has a proportion ranged between 0.01% and 0.5%. Preferably, the zirconium can enhance the strength and erosion resistance of the material.

The copper has a proportion ranged between 0.01% and 0.5,%. Preferably, after heat treatment, the copper can enhance the strength and decrease the weight of the alloy, so that the alloy has a light weight with greater strength.

The aluminum has a proportion ranged between 97.5% and 99.95%. Preferably, the optimum proportion of the aluminum is greater than 98%.

Accordingly, the aluminum based material in accordance with the present invention can be used to make a heatsink plate having a heatsink effect of 20%, so that the aluminum based material has a greater conductivity and heatsink effect. In addition, the aluminum crystal has a fined size smaller than 0.1 nanometer (0.1 nm), thereby facilitating the later working process, so that the aluminum based material can be worked easily and conveniently. Further, the aluminum based material is made of elements of smaller heat resistance and greater strength, so that the aluminum based material has greater heat conductivity and strength.

In practice, the aluminum based material is available for the conventional working process, such as extruding, punching, forging, casting, pressing or the like, to form an aluminum member, such as hollow and solid extruded member, punched member, forged member, cast member, pressed member or the like, so as to satisfy different practical requirements.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An aluminum based material, consisting essentially of: 0.01%–0.5% Sc, 0.01%–0.5% Si, 0.01%–0.5% Mg, 0.01%–0.5% Zr, 0.01%–0.5% Cu, balance aluminum.

2. An aluminum based material in accordance with claim 1, wherein the aluminum is between 97.5%; 99.95%.

3. An aluminum based material in accordance with claim 1, wherein the aluminum is greater than 98%.

* * * * *